US008069497B2

(12) United States Patent
Sheward et al.

(10) Patent No.: US 8,069,497 B2
(45) Date of Patent: Dec. 6, 2011

(54) MULTI-PURPOSE HOSPITAL GOWN

(76) Inventors: Jason Sheward, Tipton, IN (US); Carma Sheward, Tipton, IN (US)

( * ) Notice: Subject to any disclaimer, the term of this patent is extended or adjusted under 35 U.S.C. 154(b) by 360 days.

(21) Appl. No.: 12/319,258

(22) Filed: Jan. 5, 2009

(65) Prior Publication Data

US 2009/0172862 A1 Jul. 9, 2009

Related U.S. Application Data

(60) Provisional application No. 61/009,879, filed on Jan. 3, 2008.

(51) Int. Cl.
*A41D 13/12* (2006.01)

(52) U.S. Cl. ..... 2/114

(58) Field of Classification Search ..... 2/114, 51, 2/48, 52, 74, 83, 105, 69, 111, 94, 85, 102, 2/247, 106, 249, 250; 604/174, 179, 345
See application file for complete search history.

(56) References Cited

U.S. PATENT DOCUMENTS 3,803,640 A * 4/1974 Ericson ..... 2/114
4,570,268 A * 2/1986 Freeman ..... 2/114
4,622,699 A * 11/1986 Spriggs ..... 2/114
4,683,594 A * 8/1987 Feinberg ..... 2/105
4,718,124 A * 1/1988 Sawicki et al. ..... 2/114
5,050,243 A * 9/1991 Udell ..... 2/114
5,184,351 A * 2/1993 Benstock ..... 2/114
5,267,352 A * 12/1993 Rodarmel ..... 2/44
5,361,414 A 11/1994 Smith
5,444,872 A 8/1995 Johnson
6,049,907 A * 4/2000 Palomo ..... 2/51
6,134,715 A * 10/2000 McLennan ..... 2/114
6,484,321 B1 11/2002 Shamam
6,574,800 B1 * 6/2003 Leger et al. ..... 2/114
6,973,673 B2 * 12/2005 Beuk ..... 2/114
7,305,716 B1 12/2007 Richards
7,424,750 B2 9/2008 Kerr
D584,882 S * 1/2009 Trouillot et al. ..... D2/720
7,823,221 B2 * 11/2010 Green ..... 2/114
2006/0037124 A1 * 2/2006 Cho et al. ..... 2/114
2008/0184455 A1 * 8/2008 Blume ..... 2/114
2009/0100569 A1 * 4/2009 Butler ..... 2/114
2010/0242150 A1 * 9/2010 Trouillot ..... 2/114
2010/0313330 A1 * 12/2010 Sampson-Howlett ..... 2/114

* cited by examiner

*Primary Examiner* — Amy Vanatta
(74) *Attorney, Agent, or Firm* — Frank D. Lachenmaier

(57) ABSTRACT

The present invention relates generally to hospital gowns and more specifically to gowns with specific pockets, slits to allow mounting catheter bag concealed inside gown of patient for maximum mobility and privacy with various monitors, catheters and lumens attached and passing through openings in gown to reach the patient's body and closures that are simple to use and provide for patient privacy with approximately 125% wrap around.

6 Claims, 5 Drawing Sheets

MULTI-PURPOSE HOSPITAL GOWN

BACKGROUND

1. Field of Invention

The present invention relates generally to hospital gowns and more specifically to gowns with specific pockets, slits to allow for maximum mobility of patient with various monitors, catheters and lumens attached and closures that are simple to use and provide for patient privacy.

2. Prior Art

The basic requirements for hospital gowns are ease of access to various areas of the patients body for examination or treatment purposes by the medical professionals involved; a sterile garment to provide coverage of the patient during examination, hospital stay or surgery; and minimum coverage for protection of patient modesty. Various attempts have been made to improve the design of hospital gowns in these areas with some attention to improving the ease of dressing the patient in such garments but with little attention to the convenience and mobility of the patient.

SUMMARY OF THE INVENTION

An object of the multi-purpose hospital gown is to cover the patient's body for personal modesty without an over garment for ambulation to the bathroom or the hallways for other purposes.

Another object of the multi-purpose hospital gown is to allow for ease in dressing a patient either by the patient or with the help of an attendant.

Another object of the multi-purpose hospital gown is to provide a gown that is economical to manufacture and maintain.

Another object is to provide a multi-purpose hospital gown that is constructed in such a manner as to enable easy access to either the patient's front or back area.

Another object is to provide a multi-purpose hospital gown that is constructed with a telemetry pocket in the upper frontal area with a slot in the back for passage of the telemetry wires to the patient.

Another object is to provide a multi-purpose hospital gown that is constructed with additional pockets on the lower frontal area for such items as J. P. Drains, Hema Vacs, and On-Q Pumps with slots in the gown to allow for passage of connecting apparatus.

Another object is to provide a multi-purpose hospital gown that is constructed with slits on the lower right frontal area that are used for hooking a catheter bag on the inside of the gown allowing the patient to ambulate with the bag concealed.

Another object is to provide a multi-purpose hospital gown that is constructed with releasable connections on the upper seams of the sleeves.

Still further objects and advantages will become apparent from a consideration of the ensuing description and accompanying drawings. In the description, reference is made to the accompanying drawings which form a part thereof, and in which are shown, by way of illustration, specific embodiments in which the invention may be practiced. These embodiments will be described in sufficient detail to enable those skilled in the art to practice this invention, and be understood that other embodiments may be utilized and that structural changes may be made without departing from the scope of the invention. In the accompanying drawings, like reference characters designate the same or similar parts throughout the several views.

DRAWINGS

The invention is described with reference to the following drawings.

REFERENCE NUMBERS

10—Multi-purpose Hospital Gown
11—body assembly
12—body outside surface
13—body inside surface
14—waist rear tie strap
16—right neck tie strap
18—left neck tie strap
20—lower left pocket
22—telemetry pocket slot
24—lower right pocket
26—lower catheter bag slit
28—upper catheter bag slit
29—right sleeve assembly
30—body edge right sleeve rear
31—body to right sleeve rear seam
32—body edge right sleeve front
33—body to right sleeve rear seam
34—neck front
35—left sleeve assembly
36—body edge left sleeve front
37—body to left sleeve from seam
38—body edge left sleeve rear
39—body to left sleeve rear seam
40—lower right pocket slot
41—neck side right sleeve front
42—lower left pocket slot
43—neck side right sleeve rear
44—telemetry pocket
45—neck side left sleeve front
46—waist front tie strap
47—neck side left sleeve rear
48—right sleeve front
50—right sleeve rear
52—left sleeve front
54—left sleeve rear
56—right sleeve front separable edge
58—right sleeve front open end edge
59—right sleeve front bottom edge
60—right sleeve bottom seam
61—right sleeve rear bottom edge
62—right sleeve rear open end edge
64—right sleeve rear separable edge
66—female snap fastener
68—male snap fastener

70—right sleeve front edge
72—right sleeve rear edge
74—left sleeve front edge
76—left sleeve rear edge
78—left sleeve front open end edge
79—left sleeve front bottom edge
80—left sleeve bottom seam
81—left sleeve rear bottom edge
82—left sleeve rear open end edge
84—left sleeve rear separable edge
86—left sleeve front separable edge
88—body right side
90—body left side
92—body bottom edge
94—right end under arm clearance angle
95—right arm pit
96—body right top
97—left arm pit
98—body left top
99—body frontal area

DESCRIPTION

In order that the invention is fully understood it will now be described by way of the following examples in which Multi-purpose Hospital Gown 10 is shown in FIGS. 1-9.

Figure 1:
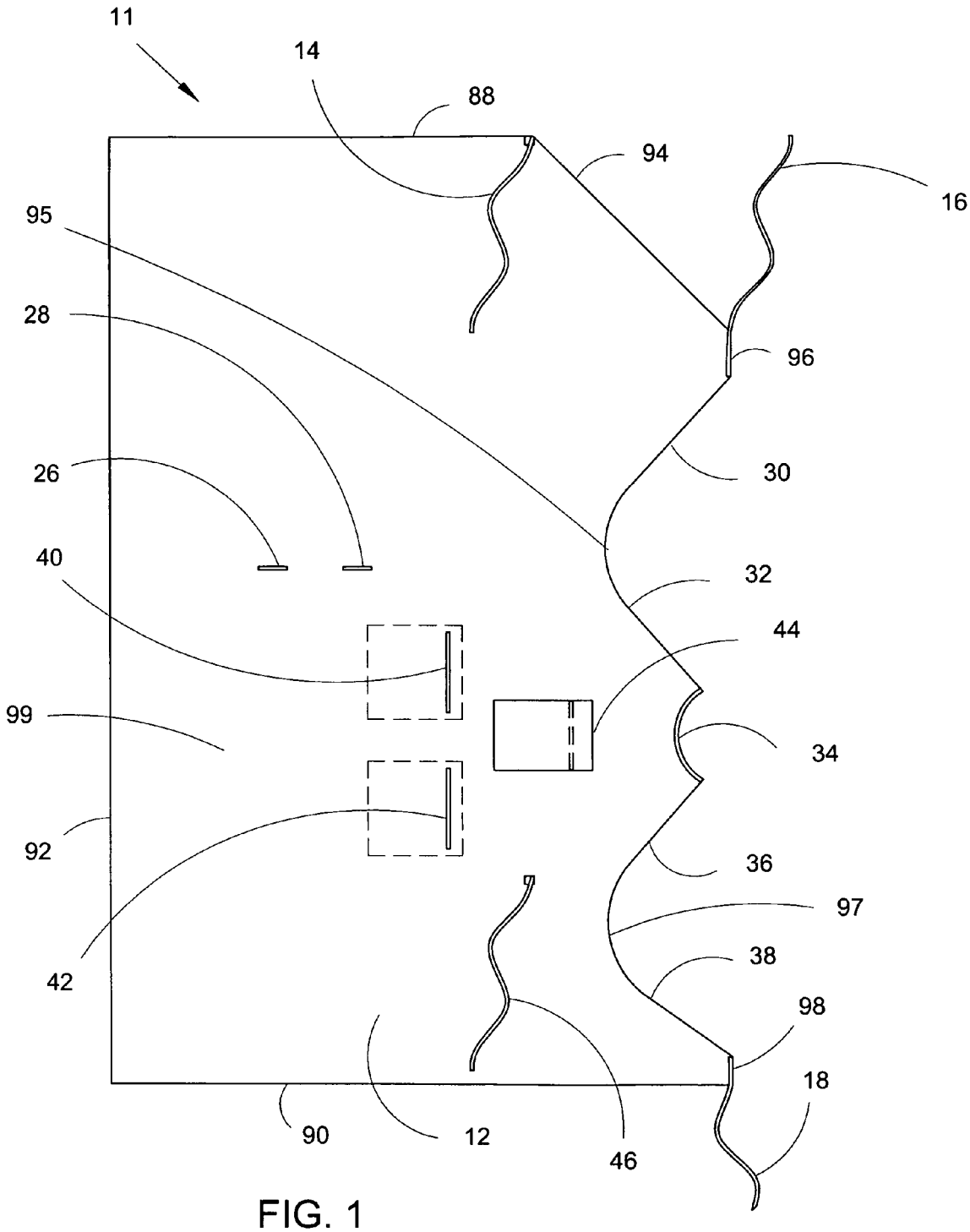
FIG. 1 is a front view of the outside surface of a Multi-purpose Hospital Gown body assembly.
Figure 2:
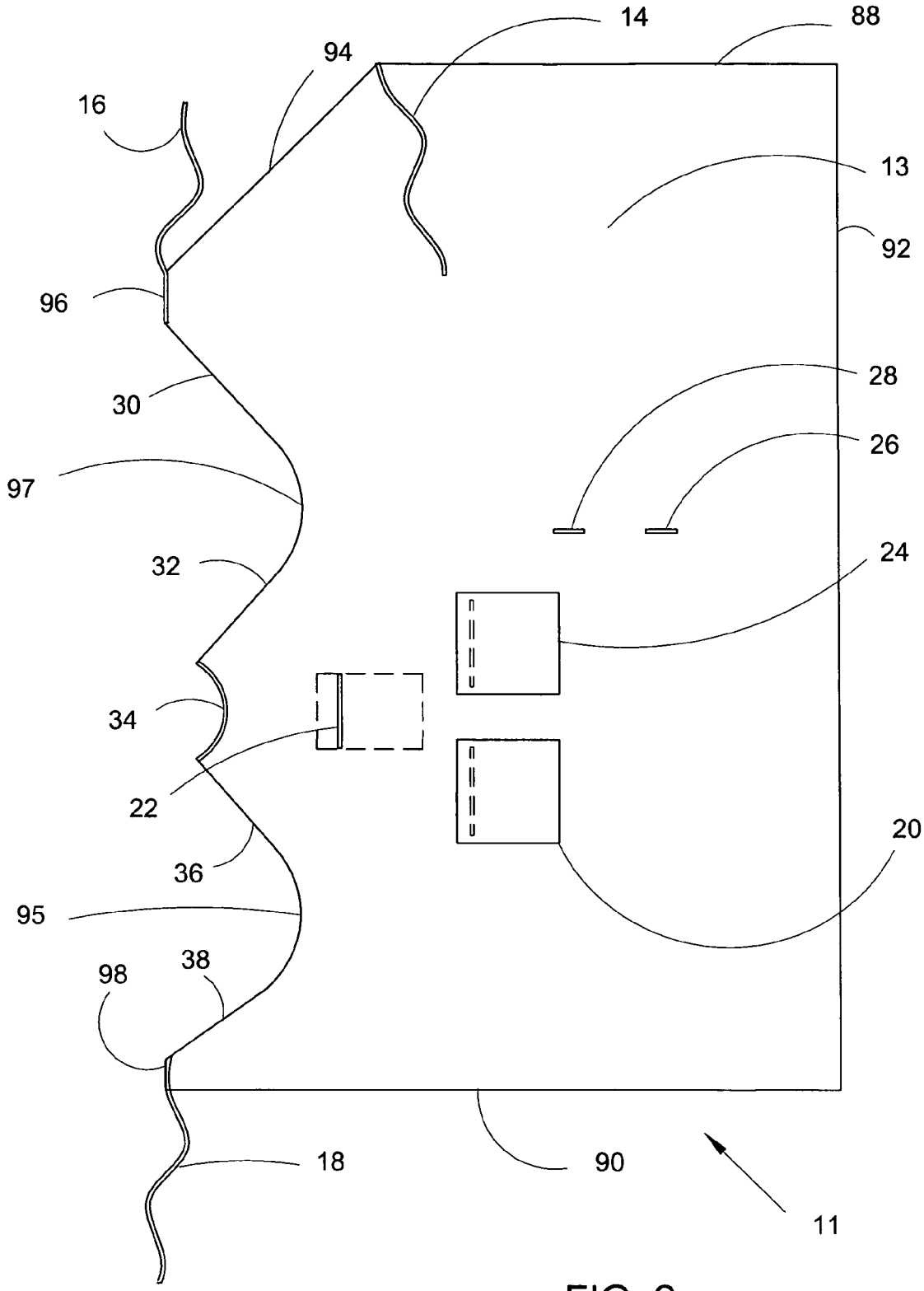
FIG. 2 is a rear view of the inside surface of a body assembly.

Turning to FIGS. 1 and 2, body assembly 11 is disclosed. Body 11 is preferably constructed of soft, washable material and is approximately 72 inches wide and 44 inches tall. These exemplary dimensions are for an average adult gown although it is understood that the dimensions for the various pattern pieces could easily be altered for several different body sizes and shapes. FIG. 1 shows lower right pocket slot 40 and lower left pocket slot 42 cut through body assembly 11 approximately 5 inches wide, providing access into pockets 24 and 20 respectively and through the tops of pockets 24 and 20 to the patient's body for apparatus attachment. Pockets 24 and 20 may be formed by sewing 6¾ inch material squares to body inside surface 13 with their bottom edges approximately 18 inches above body bottom edge 92, directly below the center of neck front 34, approximately 3 inches apart. Pockets 24 and 20 are designed to retain J. P. Drains, Hema Vacs, and On-Q Pumps or personal items if not required for a particular medical device. FIG. 2 shows left bottom pocket 20 and right bottom pocket 24 sewed to body inside surface 13.

Telemetry pocket 44 may be formed by sewing a 6½ inch tall by 5½ inch wide patch of material to body outside surface 12 with its bottom edge approximately 25 inches above body bottom edge 92, centered under neck front 34. FIG. 2 shows telemetry pocket slot 22 cut through body assembly 11, directly behind Pocket 44 where pocket 44 is designed to retain most on-body monitoring telemetry units and slot 22 is provided for connection of monitoring apparatus to the patient's body.

Right neck tie strap 16 and left neck tie strap 18 are attached to the upper ends of body assembly 11 at body right top 96 and body left top 98 respectively. Straps 16 and 18 are approximately 15 inches long as shown in both FIGS. 1 and 2. When tie straps 16 and 18 are tied together they form the closure means for the neck region of Multi-purpose hospital Gown 10. Waist rear tie strap 14 extends away from body right side 88 approximately 15 inches in length and is attached at the base of right end under arm clearance angle 94, approximately 29 inches above body bottom edge 92. Waist front tie strap 46 is attached to body outside surface 12 approximately 29 inches above body bottom edge 92, approximately 18 inches from body left side 90. When tie straps 14 and 46 are tied together they form a closure means at waist level for the wrap around design of Multi-purpose Hospital gown 10. Alternative closure means such as hooks and eyes, snaps or Velcro type fasteners are also contemplated as part of this invention.

FIG. 1 also shows two approximately 2 inch long clots slits 26 and 28 with their bottoms positioned approximately 8½ and 15 inches from body bottom edge 92, with their center-lines approximately 32½ inches from body right side 88. Slits 26 and 28 are used for hooking a Foley Catheter bag (not part of this invention) on the inside of Multi-purpose Hospital Gown 10 providing privacy for patients so encumbered during required ambulation.

Figure 3:
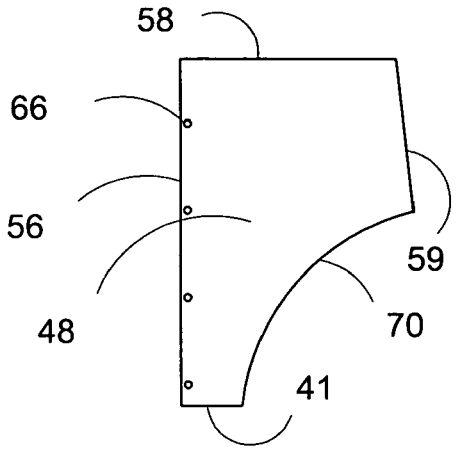
FIG. 3 is an inside view of right sleeve front.
Figure 4:
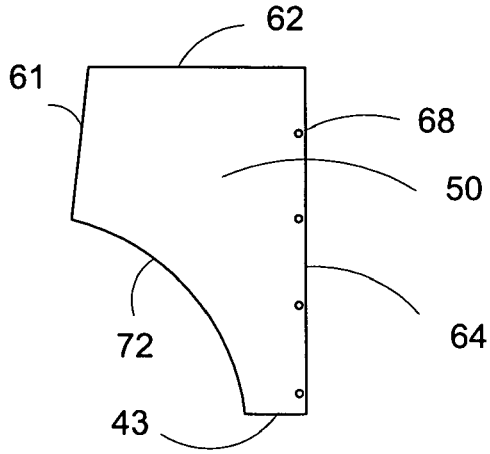
FIG. 4 is an inside view of right sleeve back.
Figure 5:
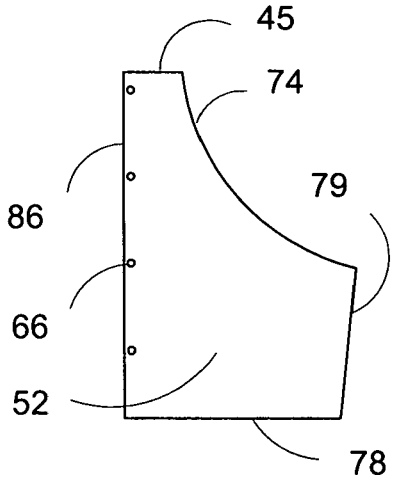
FIG. 5 is an inside view of left sleeve front.
Figure 6:
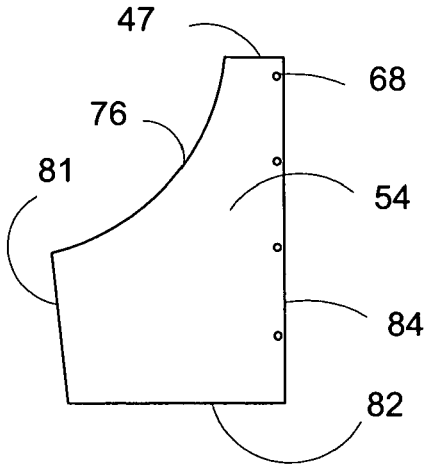
FIG. 6 is an inside view of left sleeve back.

FIGS. 3, 4, 5 and 6 show the pattern pieces for the front and rear halves of right and left sleeves 48, 50, 52 and 54 respectively. These sleeve halves are substantially identical with the exception of a plurality of male snap fasteners 68 and female snap fasteners 66 on opposing separable top edges 56 and 64 and 84 and 86. In a preferred embodiment sleeve halves 48, 50, 52, and 54 have open end edges 58, 62, 78 an 82 that are approximately 11 inches long. Bottom edges 59, 61, 79 and 81 are approximately 8 inches long and are connected to neck sides 41, 43, 45 and 47 by curves edges 70, 72, 74 and 76. Neck sides 41, 43, 45 and 47 are approximately 2 inches long. FIGS. 3 and 5 show four female snap fasteners 66 equally spaced along separable edges 56 and 86. FIGS. 4 and 6 show four male snap fasteners 68 at matching locations on their separable edges 64 and 84. The fasteners shown are for exemplary purposes and other releasable fastening devices such as ties or hook and eye systems may provide the separable connection means.

Figure 7:
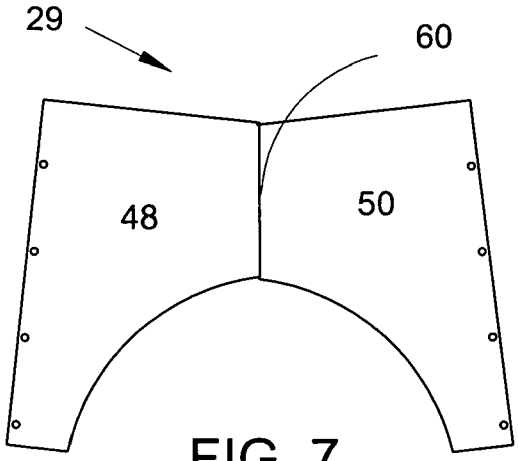
FIG. 7 is an assembled view of right sleeve.
Figure 7A:
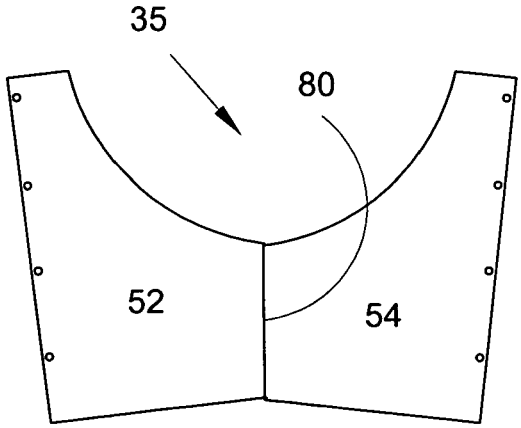
FIG. 7A is an assembled view of left sleeve.

FIG. 7 shows right sleeve assembly 29 where bottom edges 59 and 61 are affixed in bottom seam 60 and left sleeve assembly 35 is shown in FIG. 7A where bottom edges 79 and 81 are affixed in bottom seam 80.

Figure 8:
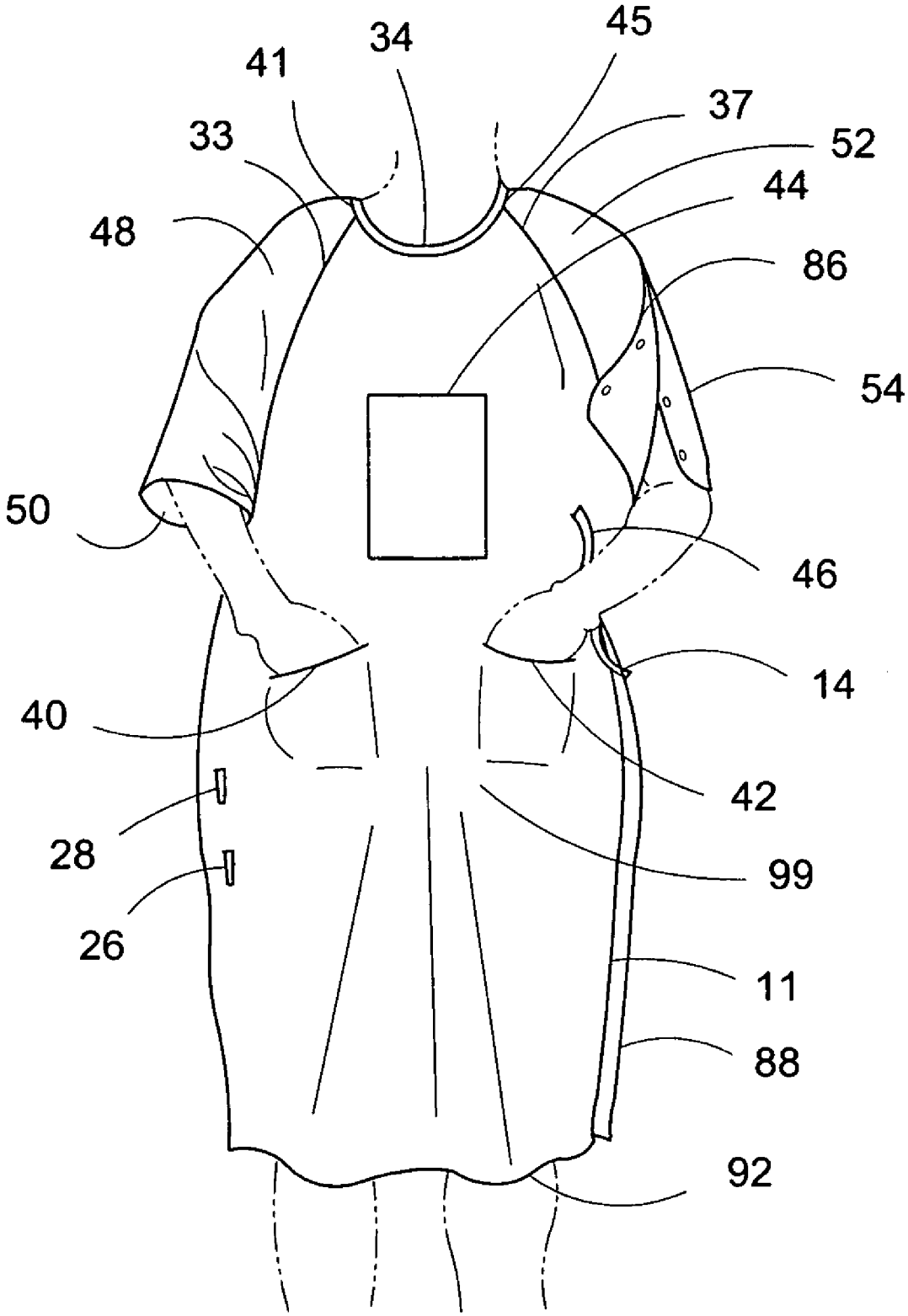
FIG. 8 is a perspective front view of gown as worn.
Figure 9:
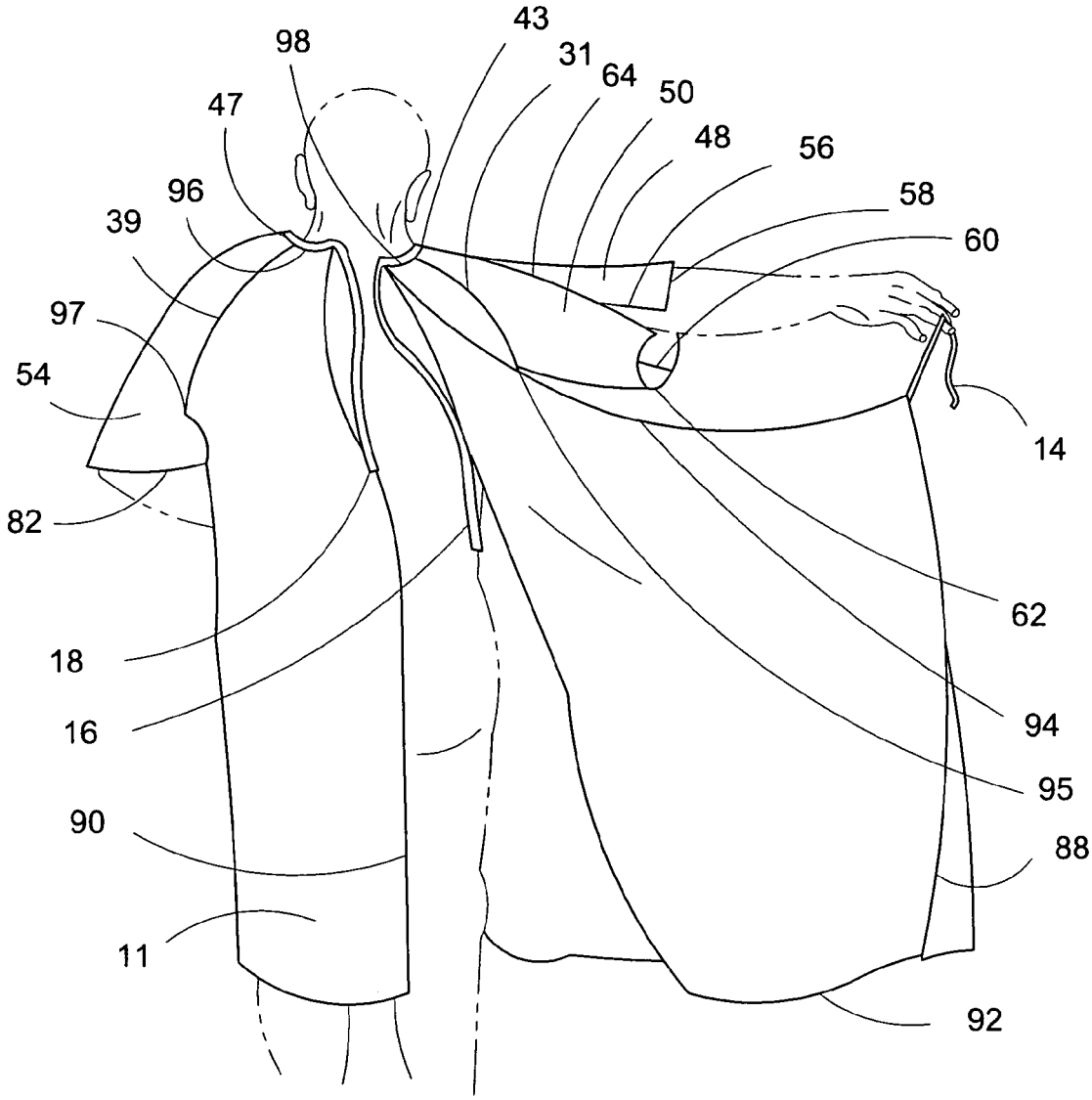
FIG. 9 is a perspective rear view of partially opened gown.

FIG. 8 is a perspective front view of Multi-purpose Hospital Gown 10 that illustrates the assembled gown and the pockets and Foley catheter bag hanging slots and the side tie in frontal area 99. FIG. 8 also shows the joining of right sleeve front 48 to body assembly 11 with body edge right sleeve front 32 sewn to edge 70 along seam 33 running from neck front 34 to right arm pit 95. This view also shows the joining of left sleeve front 52 to body assembly 11 by affixing body edge left sleeve front 36 to edge 74 along seam 39 running from neck front 34 to left arm pit 97. FIG. 9 shows the joining of right sleeve rear 50 to body assembly 11 by affixing body edge right sleeve rear 30 to edge 72 along seam 31 running from right top 96 to right arm pit 95. This view also shows the joining of left sleeve rear 54 to body assembly 11 by affixing body edge left sleeve rear 38 to edge 76 along seam 39 running from left top 98 to left arm pit 97. FIG. 9 is a perspective rear view of Multi-purpose Hospital gown 10 showing the rear ties at the neck and the wrap around feature.

Although this invention has been described by detailing a preferred embodiment with several optional attachments it is not intended to be limited to this set of materials and dimensions. Rather, the scope of this invention is defined by the following claims.

What is claimed is:

1. A multi-purpose hospital gown comprising:

a pair of substantially identical sleeve assemblies with front and rear segments, sleeve tops, and separable top seams, separable edges, and closure means;

a body assembly, including a neck front, arm pits, a right top, a left top, a frontal area, a lower right side of said frontal area, a right side, a left side, a bottom edge;

each of said sleeve assemblies being joined to said body assembly at seams that begin at said neck front for said front segments and to said left and right tops for said rear segments and curve to the bottom of said arm pit;

two vertical slits located one above the other on said lower right side of said frontal area wherein a hook from a catheter bag may be hung at two different heights above said bottom edge;

said gown is worn by placing said right side in alignment with the center of patient's back, wrapping around patient again to the center of patient's back where a closure means connects said right top to said left top behind the patient's neck, continuing on overlapping to patient's left side, dropping to waist level where closure means connects said left side to connector on the left side of said frontal area at waist level height and connecting said separable top seams of said sleeve assemblies.

2. The multi-purpose hospital gown of claim 1, further comprising a telemetry pocket centered below said neck front with a pass-through slot for connecting telemetry to patients body.

3. The multi-purpose hospital gown of claim 2, further comprising additional pockets for other medical devices with pass-through slots for interconnection between said devices and the patient's body or personal items if not required for medical devices.

4. The multi-purpose hospital of claim 1, wherein said separable edges on said sleeve tops closure means comprise a plurality of snap connectors or a plurality of tie straps.

5. The multi-purpose hospital gown of claim 1, wherein closure means between said right top and said left top are chosen from the group of tie straps, hook and eye type fasteners, or snaps.

6. The multi-purpose hospital gown of claim 1, wherein closure means for said left side to waist high connector on left side of said frontal area are chosen from the group of tie straps, hook and eye type fasteners, or snaps.

* * * * *